US005527129A

United States Patent [19]

McKinnon

[11] Patent Number: 5,527,129

[45] Date of Patent: Jun. 18, 1996

[54] ELLIPTICAL ORBIT COMPACTION CURB FORMING AND EXTRUDING APPARATUS

[75] Inventor: Paul G. McKinnon, 807 West Forest, Brigham City, Utah 84302

[73] Assignee: Paul G. McKinnon, Brigham City, Utah

[21] Appl. No.: 401,811

[22] Filed: Mar. 10, 1995

[51] Int. Cl.[6] ..... B28B 3/02; E01C 11/22

[52] U.S. Cl. ..... 404/98; 425/64

[58] Field of Search ..... 404/7, 96, 98; 425/64, 62

[56] References Cited

U.S. PATENT DOCUMENTS

| | | | |
|---|---|---|---|
| 2,932,875 | 4/1960 | Butcher | 404/98 X |
| 3,625,121 | 12/1971 | Blumer | 404/96 X |
| 3,733,140 | 5/1973 | James, III | 404/98 |
| 3,733,141 | 5/1973 | James, III | 404/98 |
| 3,915,584 | 10/1975 | Coho, Jr. et al. | 404/98 |
| 4,217,065 | 8/1980 | Stilwell | 404/98 |
| 4,310,293 | 1/1982 | Eggleton | 404/98 X |
| 4,548,565 | 10/1985 | Bunn | 425/64 |
| 4,566,823 | 1/1986 | May | 404/98 |
| 4,984,932 | 1/1991 | Leone | 404/98 X |
| 5,018,955 | 5/1991 | Parrish et al. | 404/98 X |

*Primary Examiner*—David J. Bagnell
*Assistant Examiner*—James A. Lisehora
*Attorney, Agent, or Firm*—Marcus G. Theodore

[57] ABSTRACT

A manually operable and steerable curb extrusion device for extruding curb, barrier, wall, gutter or the like from concrete, cement or some other moldable building material. The curb extrusion device has a hopper into which building materials are placed to fall onto a reciprocating orbital compaction member which compacts, kneads, and forces the building material through an open ended extrusion mold where it is shaped before extrusion.

10 Claims, 5 Drawing Sheets

ELLIPTICAL ORBIT COMPACTION CURB FORMING AND EXTRUDING APPARATUS

BACKGROUND

1. Field.

This invention relates to concrete curb forming and extruding apparatus. More particularly, it relates to a concrete curb forming and extruding apparatus with wheel adjustment locks, and a slip form shaping the cementitious material into a continuous curb forced therethrough by an extruder which receives materials stored in a hopper. The extruder has a reciprocating elliptical orbit compacting member which on the compaction stroke simultaneously moves forward to compact the concrete and lifts upward slightly just before the return stroke to force the compressed concrete against the upper surface of the slip form to fill the same and form the continuous curb. On the return stroke, it moves back and slightly downward to collect more concrete from the hopper for compaction on the compaction stroke. This elliptical or arcing orbital movement of the compaction end of the compaction member will hereinafter be referred to as an elliptical orbit or elliptical orbit compaction.

2. State of the Art.

Present concrete curb forming and extruding machines have a reciprocating ram or an auger to force concrete material into a slip form forming a running curb. The concrete material is usually of a dry consistency to hold the form of the curb after being extruded from the machine. The dry consistency of the material causes it to bridge from side to side in the hopper and not fall through into the compaction chamber. It is common practice to have two men run the machine—one to steer and control the machine while the other shovels small amounts of material into and through the hopper.

The ram type of curb forming and extruding machines move ahead when a shovel of material is put through the hopper. This forward movement is generally two or three inches per stroke. The ram then cycles without moving the machine until the next shovel of material is put through the hopper. This erratic action causes voids which have to be filled. It also causes curb cracks when the machine coasts at the end of the stroke.

These ram type machines use a gear box to reduce the speed with a crank arm connected to a flat faced member which is pushed by the crank through the compaction chamber or housing displacing the curbing material through the slip form to form the curb. May, U.S. Pat. No. 4,566,823 is an example of a manually operable curb extrusion device with interchangeable molds and compacting members wherein building material is placed in a receiving hopper and falls into a compacting chamber where a power driven and reciprocating compacting member compacts the material into the extrusion mold where it is shaped and extruded. The curb extrusion device is manually directed or steered along the desired course via an adjustable steering mechanism, and has a hopper with one straight upright side, screw-on molds, and adjustable legs connected to the wheels. Eggleton, U.S. Pat. No. 4,310,293 is another example of a ram driven concrete curb molding apparatus.

Ram machines have been the most popular because of their positive upward travel. However, straight compressive forces are not conducive to better compaction. Varying sizes of particles resist compaction and stack one against another, leaving voids or cavities between the particles. Voids cause porous concrete with diminished compressive test strengths.

The ram of the ram curb forming machine also picks up some of the concrete material on the return back-stroke which is then deposited as a trail of material down the sides of the curb as waste. This slag has to be cleaned up or pressed down out of sight and buried. Ram machines, as the speed of the ram is increased, tend to jump ahead and then coast forward at the end of the stroke which puts cracks in the top surface of the curb. Loose parts on the machine, such as wheels, can also leave marks in the extruded curb.

Auger type curb forming machines use an auger to move material through a compaction chamber into the slip form,. McKinnon, U.S. Pat. No. 5,354,189, unlike other auger systems, will travel as effectively up and down hills as it employs vibrating augers which apply pressure for compaction to forces material through a mold rearward, thereby propelling the machine forward. In addition, the vibrating augers prevent material from becoming captive to turn with the augers. Other auger systems are: Smith, U.S. Pat. No. 3,137,220 which discloses a curb-laying machine with a number of oppositely rotating augurs to extrude the concrete for forming curbs; Parrish et al., U.S. Pat. No. 5,018,955 utilizes a single auger to extrude the concrete and features a slip-on curb form with various adjustment options; Bunn, U.S. Pat. No. 4,548,565, Coho. Jr. et al., U.S. Pat. No. 3,915,584; and W. E. Canfield et al., U.S. Pat. No. 2,818,790.

Cited for general interest are: Aparicio, U.S. Pat. No. 3,915,583 disclosing a paving machine slip form, Baucum, U.S. Pat. No. 4,298,293 disclosing a drag line operated slip form curb forming machine, and Leone, U.S. Pat. No. 4,984,932 disclosing an apparatus for continuous formation of concrete curbs via the raising and lowering of the molding to form thresholds for driveways, and intermediate tapering sections for transitions between full height curbs and thresholds.

The present invention avoids the ram compaction waste problems, and provides an improved curb forming and extruding machine which provides a curb having strong compressive strength with a smooth finished look requiring no manual troweling. The elliptical orbit compaction also allows a shovel full of material to be fed more evenly through the apparatus over a number of ram strokes. This builds a more evenly compacted continuous curb without voids or cracks.

SUMMARY OF THE INVENTION

The present invention is directed to an improved manually maneuverable elliptical orbit compactor curb forming extruder propelled apparatus to form concrete, cementitious and other similar plastic building materials into linear curbs. It comprises a chassis frame and hopper with walls defining a compaction chamber. The compaction chamber has a rear opening in communication with a slip form through which is rearwardly directed the building material; thereby depositing against the ground a formed curb which simultaneously propels the apparatus forward. Steering and castering wheels are attached to the chassis frame via swinging arms which allow the wheels to be adjusted from side to side for steering to avoid obstacles in the path of the apparatus. Jack leveling means are generally associated with the swinging arms to adjust the height and level of the chassis frame so that the curb is formed to meet the needs of the user. Preferably, quick releasing arm locks are associated with the wheels to wedge the swinging arms into the desired position to prevent play or looseness.

Part of the chassis frame defines a hopper having a bottom outlet, and structured to receive, hold, and gravity feed building material into and through the bottom outlet. The lower hopper segment defines a building material compaction assembly with a compacting chamber surrounding a reciprocating elliptical orbit compacting member mounted to the chassis frame. The compacting chamber receives cementitious material from the hopper on the return stroke, and on the compaction stroke simultaneously lifts and forces the building material rearward through the outlet and upward against the top of the slip form to push, knead, and vibrationally compact the concrete into and through the compaction chamber and slip form. This elliptical orbit compaction motion provides simultaneous compression and compaction to fill completely the mold, preventing voids and loss of waste material. Also, the compacting member is self cleaned on the return stroke as the compacting member recedes back at a higher elevation, wiping itself clean against the forward lip of the hopper to prevent cementitious material from entering into the elliptical orbit mechanism.

Preferably the hopper has one straight up vertical side above the compaction chamber making it easier for the operator to see and get close to vertical surfaces next to the path of the new curb. The compaction chamber may extend under the side of the hopper to force material into a slip form also structured to extend and fit under a fence or low barrier. When used with variable slip form molds, the hopper may include adjustably connected sides which can be adjusted to vary the width of the compaction chamber.

In its simplest configuration, the elliptical orbit compactor is operated with two men—one to steer and control the machine, while the other shovels small amounts of material into and through the hopper.

For use with a single operator, a larger capacity self feeding segmented vibrating hopper design may be employed. In this embodiment, the hopper has upper and lower segments which are separately joined and associated with vibration means in a similar manner as that disclosed in McKinnon, U.S. Pat. No. 5,354,189 so each segment vibrates independently to aid in self feeding cementitious material into the compaction chamber. These separable segments are generally covered with a flexible rubber or plastic liner to flexibly seal the segments of the hooper and prevent the cementitious building material from sticking in the hopper.

However, vibration means are not required to be associated with the hopper or compaction chamber as the orbital compaction motion of the compacting member insures continuous vibration and feed of the building material into the compaction chamber. By elliptically orbit compacting the cementitious material, a more compact material is thus provided for producing a stronger concrete requiring less finishing because of fewer voids. It also insures that the compaction chamber is always filled, minimizing power consumption and maintaining propulsion pressure. Also, a drier better hydrated concrete material may be used to better hold the form of the curb after being extruded from the machine.

A removable interchangeable slip form mold with open forward and rearward ends and an open bottom is positioned in communication with the compaction chamber rear opening to receive and sectionally form the building material into a continuous curb. This slip form may be made of two parts essentially divided in half to form curbs around vertical projections. For example, the split form mold may be used to form a linear curb between and around the posts of a fence. When next to the post, half of the mold is removed and the post itself acts as an abutment around which half a curb is formed. When the machine moves past the post, the other half of the mold is reattached to form a continuing full width linear curb segment between the posts.

As discussed above, sideward projecting slip forms are generally structured and positioned such that their rearward openings extend to the side of the compaction chamber so that the open end of the mold extends under and forms a curb beneath low lying fences or barriers.

Interchangeable slip form molds are preferably releasably attached via a spring bar retainer so that other interchangeable slip form molds can be readily inserted to provide curb designs of desired cross-sections and widths. Where a patterned or textured finish is desired, a rolling pattern member similar to that disclosed in McKinnon, U.S. Pat. No. 5,354,189 may be mounted to the chassis frame and positioned after the rear opening of the slip form to impress onto the surface of the newly formed curb a desired pattern finish.

In one preferred embodiment, the slip form mold includes means to vary the width and height of the slip form cross sectional openings to produce a variable width and height slip form. This variable slip form mold enables curbs of differing widths and heights to be produced without the necessity of maintaining an inventory of different sized slip forms. In one variable slip form embodiment, the halves of the slip form mold are extendable and slideably connected and releasably secured at a desired form width varying from 4 inches to 14 inches. Attached to the bottom perimeter of this variable slip form mold is an extendable skirt which is also slideably connected and releasably secured at a desired form height. By adjusting the width of the forms and the height of the skirt, the desired height and width curb may be produced without the necessity of changing forms. This variable form is particularly useful to produce a fixed elevation curb along uneven ground. It is also useful to produce differing width curbs against uneven fences or vertical surfaces.

Preferably, when using different sized or varying slip forms, the orbital compacting member is adapted with an interchangeable compaction head which can be changed to correspond in size to the cross sectional area of the slip form to insure complete compaction and filling.

A drive motor, such as an electrical or internal combustion engine, is operably associated with the orbital compacting member to power the same. Usually the drive motor includes a gear box mounted to the chassis frame to adjust the gear box output shaft drive speed. In addition to a gear box, speed adjustment means, such as a spring motor pulley associated with an electrical drive motor, or a throttle associated with an internal combustion engine, may be included to vary the input speed of the drive motor shaft.

The elliptical orbit compaction motion of the compacting member is accomplished by attaching a crank arm to the output shaft of the gear box and operably connecting said crank arm via an oscillating connecting bar bearing mounted along a fixed guide track subassembly attached to the frame chassis. Operably associated with the connecting bar is a rocker bar attached to a compacting member, causing the compacting member also to move in a forward and backward elliptical orbit motion. This elliptical orbit motion moves the compacting end of the compacting member back and forth within the compacting chamber to push cementitious materials out its rear opening, while simultaneously lifting and compacting the cementitious material at the end of the compaction stroke against the top of the slip form for better form filling. At the end of the compaction stroke, the orbital compacting member decelerates for a soft upward stroke, working the material into place and slowing the machine for a smooth temporary stop.

Other mechanisms may be included to move the compacting surface of the elliptical orbit compacting member in a full elliptical. For example, a race in the walls of the chassis frame along which a pin mount attached proximate the end of the orbital compacting member may be used to to move and guide the orbital compaction member along the race in a partial elliptical orbit motion. However, the fixed guide track configuration with two guide rollers associated with the compacting member, discussed above, not only generates a complete elliptical orbital compaction motion, but results in less wear than a slot mounted partial arc assembly.

In comparison tests with conventional ram type curb forming machines, it was found that conventional ram type curb forming machines continually compress cementitious material into the mold; thereby causing some material to squeeze under the compaction member dragging excess material with it on the return stroke. This results in a loss of approximately 15% excess material. Conversely, the orbital compacting member not only forces the cementitious material into the mold, but after the end of the compaction stroke it drops downward to capture excess material which is then kneaded into and through the mold on the next compaction stroke. This orbital stroke curb forming machine therefore results in significant reductions in the cementitious material required, and further provides a better filled mold. It also allows the orbital curb forming machine to be operated longer before re-filling, because cementitious material is not lost through waste seepage.

Where reinforcing bars or rods rods are required to be inserted within the curb, a guide with an opening sized to accommodate the rods may be attached to the chassis frame beneath the apparatus.

The present invention therefore provides an efficient single operator curb forming machine which minimizes waste, and provides exceptional compacted concrete curbs which require minimal finishing. It is also self feeding because when the compactor sweeps up at the end of the compression stroke and then drops down, the incoming cementitious material is lifted and then allowed to fall breaking up the cementitious material in the hopper to prevent bridging in the hopper and provide a constant feed. Along with better feed, this elliptical orbit compaction fills the top of unusual shaped slip form molds resulting in better curbing without voids; thereby requiring less finishing work.

DESCRIPTION OF THE ILLUSTRATED EMBODIMENTS

Figure 1:
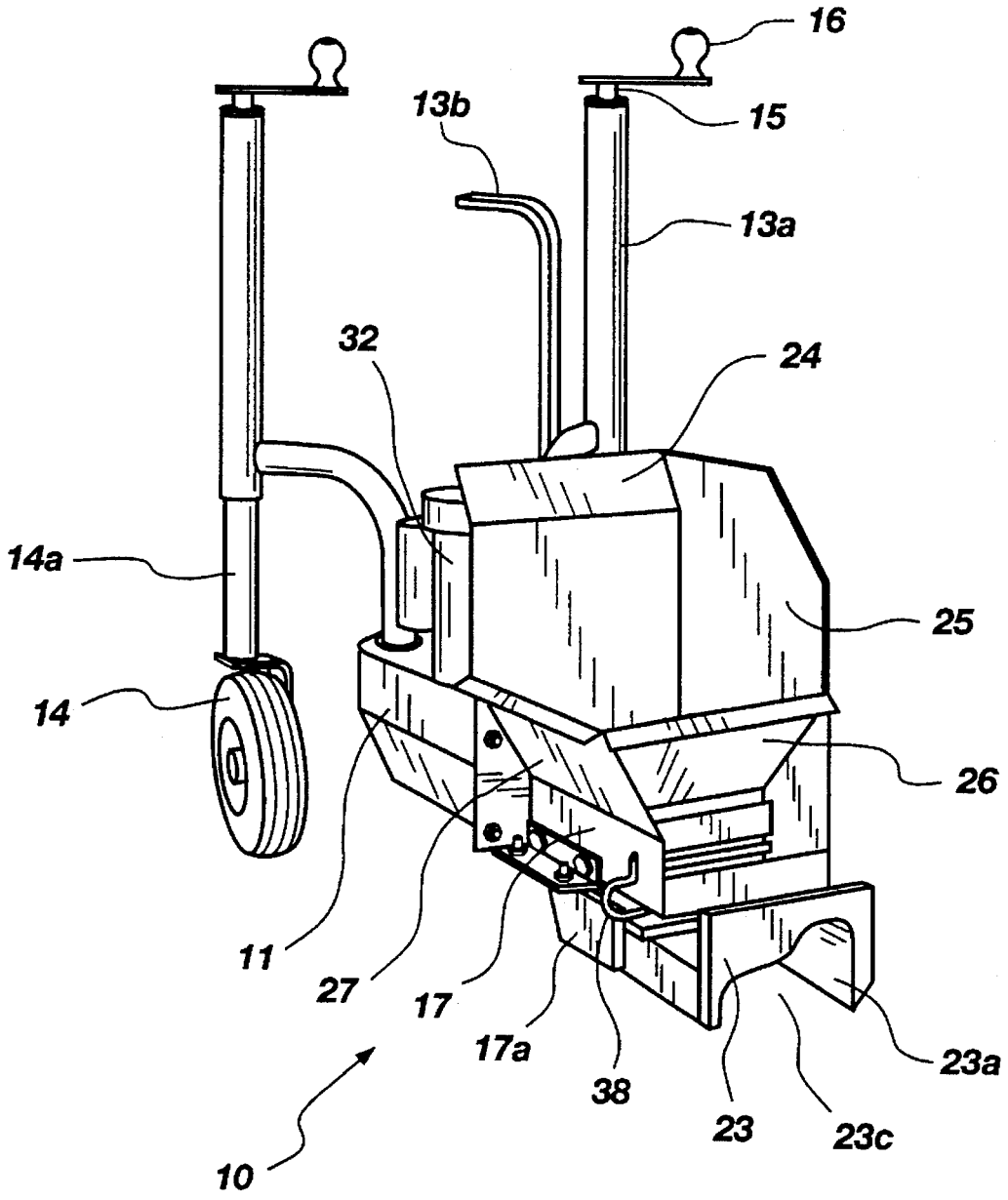
FIG. 1 is a perspective view of a preferred embodiment of the invention.

FIG. 1 is a perspective view of a preferred embodiment of the elliptical orbit compaction curb forming and extruding apparatus 10. A chassis frame 11 has a steering wheel 12 pivotally attached to a wheel leg 13 and secured via a position locking pin (not shown). A second castering wheel 14 (shown in FIG. 2) is also pivotally attached to a castering wheel strut 14*a* and secured via a second positioning locking pin 15 to enable said wheels 12, 14 to support and allow the curb forming and extruding apparatus to roll in alignment to position the curb to be laid. The wheels 12, 14 are elevated via jack cranks 16 (shown in FIG. 3) which operate jack screws and jack screw nuts (not shown) operably associated with the steering wheel strut 13*a* to elevate the curb forming device 10 to the desired height. These wheels 12, 14 may include quick release means (not shown) to allow their removal for re-positioning of the curb forming machine 10.

Associated with the steering wheel 13 strut assembly 13*a* is a steering handle 13*b* to assist an operator in controlling and aligning the curb forming machine 10.

Figure 4:
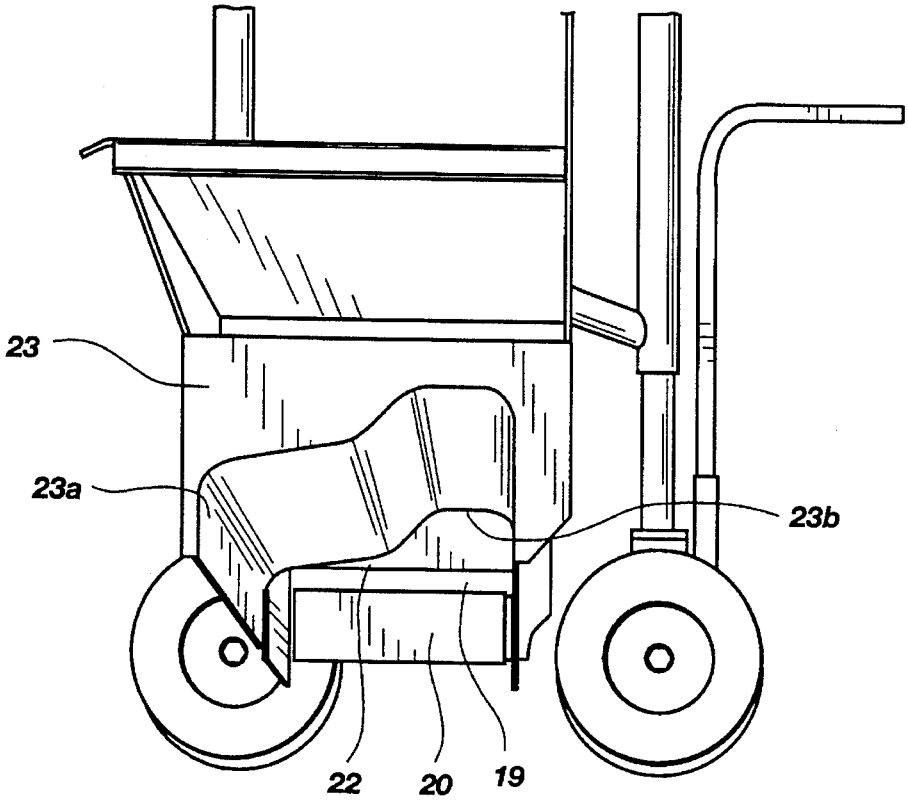
FIG. 4 is a side view of the slip form and compaction chamber of the invention shown in FIG. 1.

The chassis frame 11 defines a hopper 17 with a lower hopper segment 17*a* and an upper hopper segment 17*b* operably associated therewith. The upper hopper segment 17*b* has a feed opening 18 (shown in FIG. 7) held above the chassis frame 11. It is structured to receive, hold, and gravity feed building material into and through the lower hopper segment 17*a*. The lower hopper segment 17*a* has a bottom outlet 19 (shown in FIG. 4) which defines a compaction chamber 17*c*. The compaction chamber 17*c* surrounds the compacting surface 20 of the compacting member 21 orbitally mounted to the chassis frame 11 to receive materials from the hopper bottom outlet 19 and force the building material rearward into and through the compaction chamber 17*c* rear opening 22 leading into an open ended slip frame mold 23. The building material then passes through the slip frame 23 to form a continuous curb deposited against the ground which simultaneously propels the apparatus 10 forward.

Figure 2:
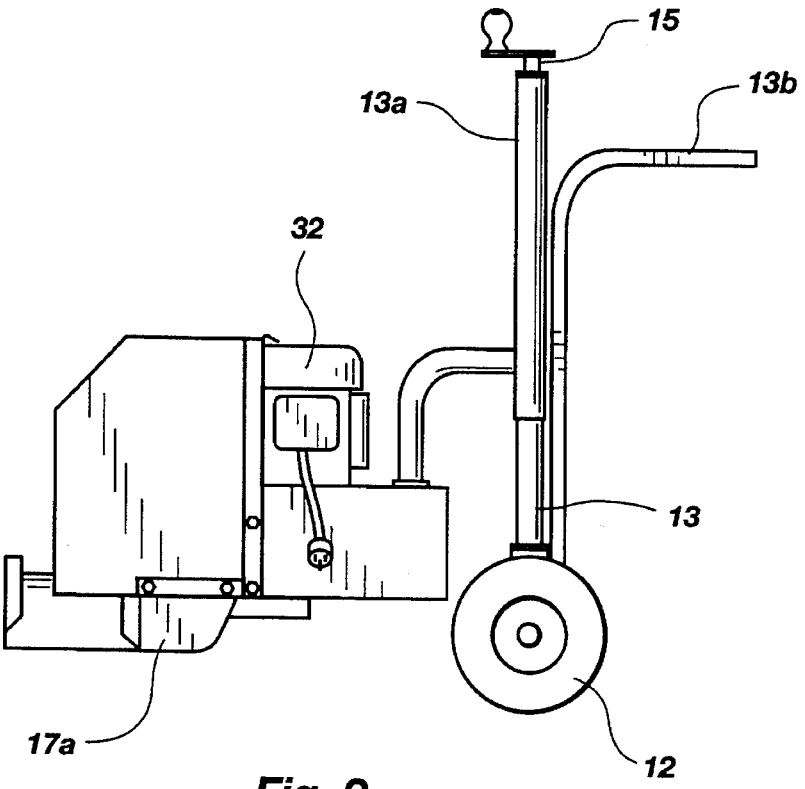
FIG. 2 is a side view of the preferred embodiment of the invention shown in FIG. 1.
Figure 3:
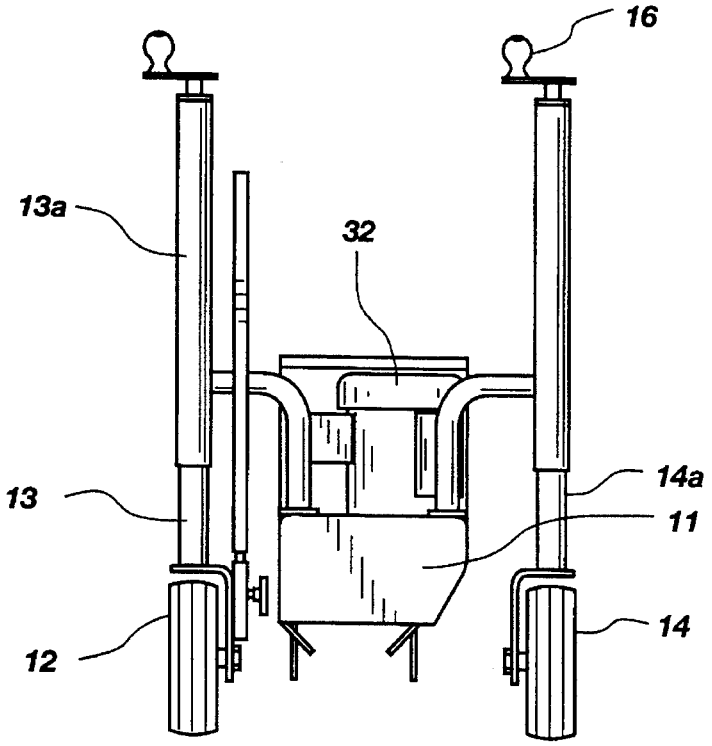
FIG. 3 is a rear view of the preferred embodiment of the invention shown in FIG. 1
Figure 7:
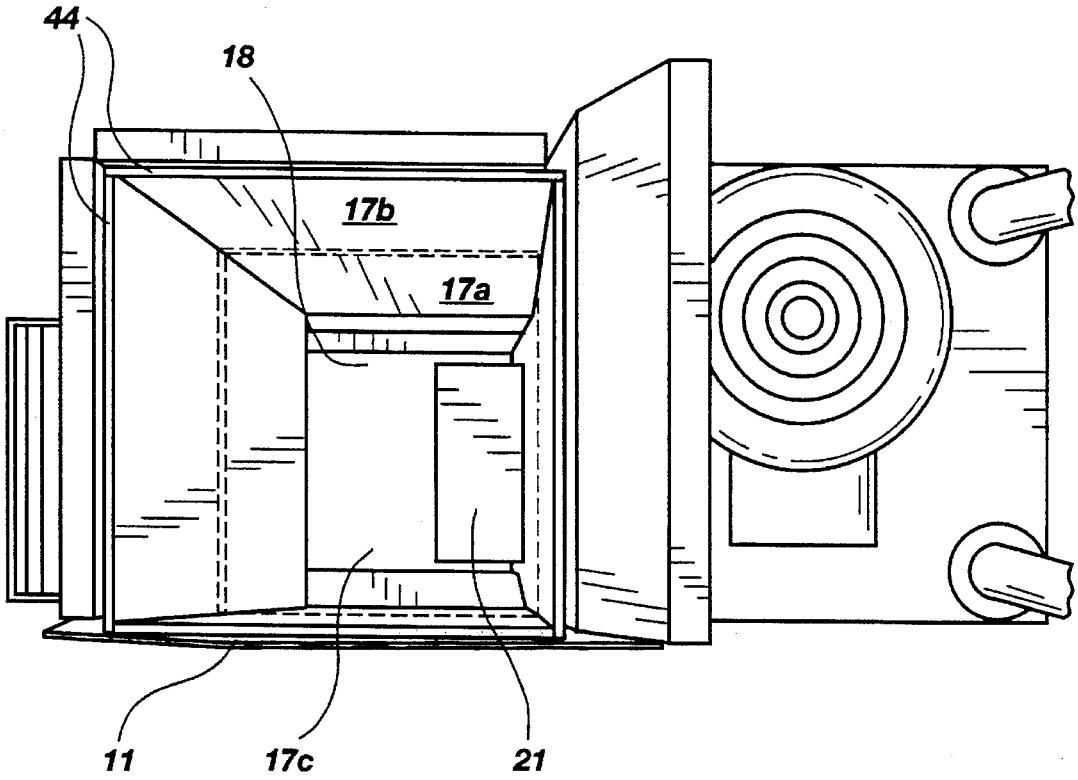
FIG. 7 is a top view of the hopper and elliptical orbit compacting member.

Preferably the hopper 17 has one straight up vertical side above the compaction chamber 17c as shown in FIGS. 1, 2, and 7, making it easier to see, align and get close to vertical surfaces next to the path of the new curb. The particular hopper 17 shown has two extending adjoining vertical sides 24, 25 projecting above the opposite adjoining vertical sides 26, 27 to form a catch surface to aid in shovel filling the hopper 17.

Figure 5:
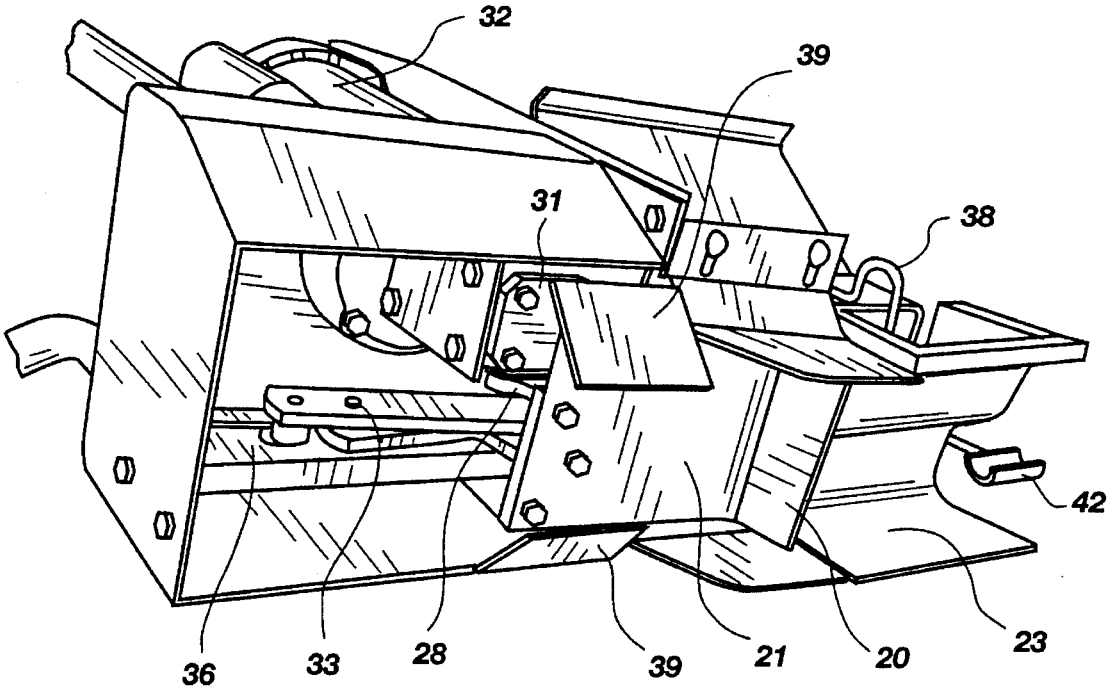
FIG. 5 is a bottom view of the elliptical orbit compactor assembly of the invention shown in FIG. 1

As shown in FIG. 5, the elliptical orbit compacting element 21 is crank driven via a crank arm 28 attached to the output shaft 30 of a gear box 31 attached to the drive shaft (not shown) of the motor 32 attached to the chassis frame 11. The crank arm 28 is operably connected to a connecting bar 33 bearing mounted along a fixed guide track subassembly 34 having two guide rollers 35 which roll along the fixed guide track 36. Attached to the connecting bar 33 is a rocker bar 37 which oscillates in an elliptical orbit motion. Removably attached to the rocker bar 37 is the compacting member 21 with a compacting surface 20. In the embodiment shown, the compacting surface 20 moves approximately 3 inches forward and backward, and from ½ to ⅝ inches up and down along the elliptical orbit path. The compacting member 21 thus attached moves back and forth in an elliptical orbit to push cementitious materials out the rear opening 22 of the compaction chamber 17*c*. The compacting member 21 has a compacting surface 20 shown in a rectangular shape, but in other embodiments, the compacting surface 21 has a shape corresponding to the shape of the cross section of the slip form mold 23.

A removable slip form mold 23 with open forward and rearward ends 23*a*, 23*b*, and an open bottom 23*c* is positioned in communication with the compaction chamber rear opening 22 to receive and sectionally form the building material into a continuous curb form against the ground. Preferably, the slip form 23 is releasably attached via a spring bar retainer 38 shown in FIG. 1 so that other interchangeable slip form molds 23 can be readily inserted to provide the desired curb design cross-section.

Skirts 39 shown in FIG. 5 may be attached beneath the frame 11 below the compacting member 21 to catch any leaking cementitious material encountered during compaction cycle and direct the same beneath the path of the newly formed curb for incorporation into the same.

Figure 6:
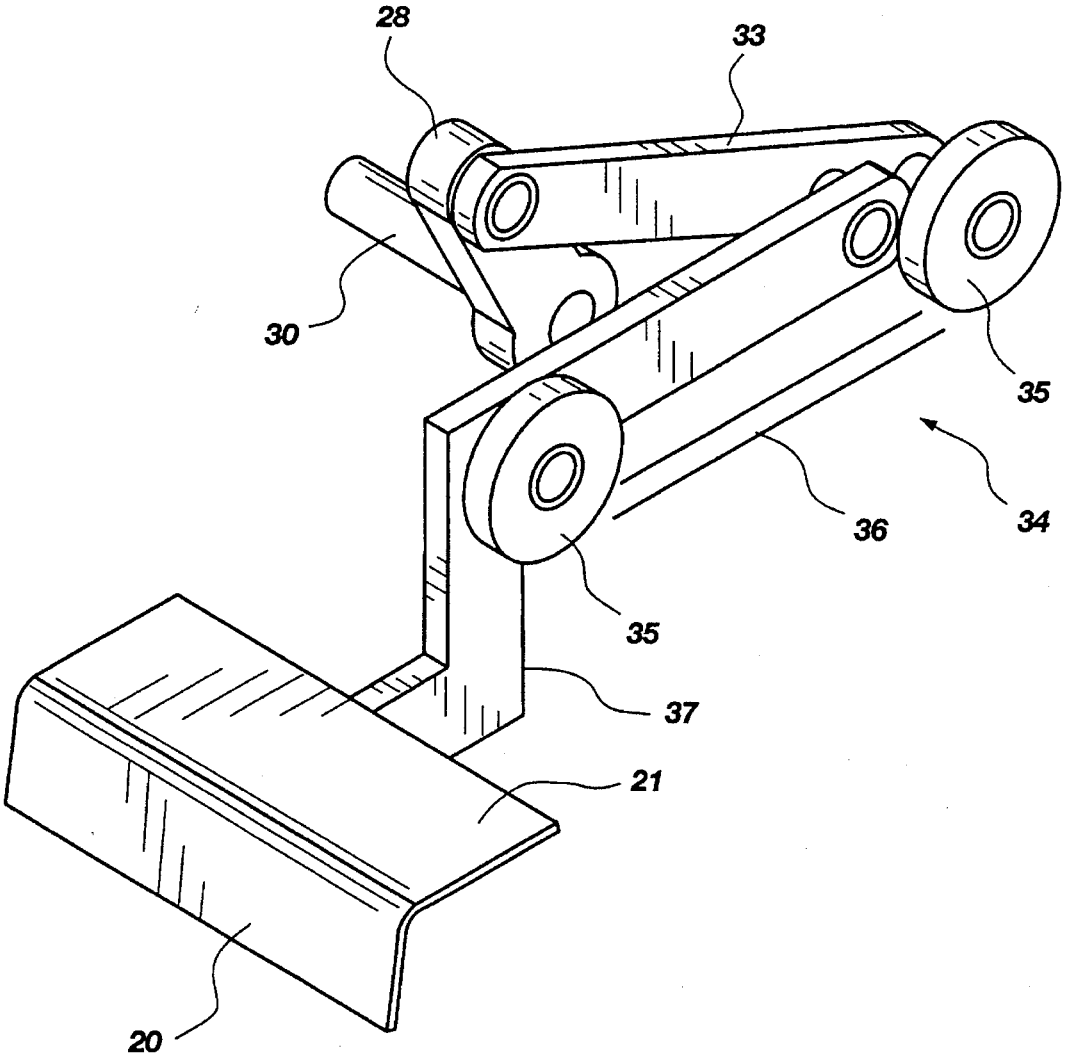
FIG. 6 is a perspective view of the crank and fixed guide track subassembly.

FIG. 6 shows the crank arm 28 associated with the fixed guide track subassembly 34. The compacting member 21 is attached to the rocker bar 37 via a plate mount which allows different sized and shaped compacting members 21 to be interchangeably attached for use with different slip form molds 23. Where reinforcing bars or rods are required to be inserted within the curb, a guide 42 with an opening sized to accommodate the rods may be attached to the chassis frame 11 beneath the apparatus 10.

Although the above description refers to the illustrated embodiments, it is not intended to restrict the scope of the appended claims. The claims themselves contain those features deemed essential to the invention.

I claim:

1. A manually maneuverable curb forming extruder propelled apparatus for concrete, cementitious and other similar plastic building materials comprising:

a. a chassis frame with walls defining a feed hopper structured to receive, hold, and gravity feed building materials into a compaction chamber having a front and rear with a rear opening which directs building materials through the rear opening to propel the chassis frame forward, b. steering and castering wheels attached to the chassis frame via swinging arms which allow the wheels to be adjusted from side to side for manual steering of the apparatus, c. a reciprocating compacting member having a compacting surface orbitally mounted to the chassis frame such that the compacting surface moves in a reciprocating elliptical orbit within the compaction chamber to withdraw, drop and receive building materials from the bottom outlet of the hopper in a loading stroke, and to force and lift the building materials rearward into and through the rear opening of the compaction chamber in a compaction stroke;

d. a removable slip form with open forward and rearward ends and an open bottom in communication with the compaction chamber rear opening to receive and sectionally form the building material into a continuous curb form, and e. a drive motor associated with the compacting member to reciprocate and orbitally move the compacting member.

2. A manually maneuverable curb forming extruder propelled apparatus according to claim 1, including leveling means associated with the swinging arms to adjust the height and level of the chassis frame.

3. A manually maneuverable extruder propelled curb forming apparatus according to claim 1, including a guide with an opening mounted to the chassis frame beneath the compaction chamber and structured to accommodate and travel along a reinforcing rod to align the apparatus and form a finished curb about said reinforcing rod.

4. A manually maneuverable extruder propelled curb forming apparatus according to claim 1, wherein the slip form is releasably attached via a spring bar retainer.

5. A manually maneuverable extruder propelled curb forming apparatus according to claim 1, wherein the slip form is mounted to a wall of the hopper such that the slip form can be inserted beneath and form a curb under the bottom of an overlying fence or barrier.

6. A manually maneuverable curb forming extruder propelled apparatus according to claim 1, wherein the hopper has separate flexibly connected upper and lower segments, and includes vibration means associated with the compacting member and the lower segment of the hopper such that the compacting member and the lower segment of the hopper vibrate in opposite directions, alternatively coming together and then separating to drop the building material onto the compacting member for continuous compaction and feed of said building material to prevent bridging in the hopper and provide a more compacted building material.

7. A manually maneuverable extruder propelled curb forming apparatus according to claim 6, wherein the drive motor includes a gear box mounted to the lower segment of the hopper defined by the chassis frame with an eccentric bearing mounting connection reciprocating the compaction member, while at the same time forcing the lower segment of the hopper in opposition to the reciprocating compaction member such that the compaction member and the lower segment of the hopper vibrate in opposite directions.

8. A manually maneuverable extruder propelled curb forming apparatus according to claim 7, including a rubber liner in the hopper to flexibly seal the upper and lower segments of the hopper.

9. A manually maneuverable extruder propelled curb forming apparatus according to claim 1, including skirts attached beneath the frame below the compacting member and positioned to capture any leaking cementitious material generated during compaction and direct the same beneath the path of the newly formed curb for incorporation.

10. A manually maneuverable extruder propelled curb forming apparatus according to claim 1, including speed adjustment means associated with the drive motor.

* * * * *